United States Patent [19]

Katayama et al.

[11] Patent Number: 4,502,441

[45] Date of Patent: Mar. 5, 1985

[54] INPUT/OUTPUT UNIT MODIFIABLE ENGINE IGNITION CONTROL APPARATUS

[75] Inventors: Hiroomi Katayama, Machida; Yoshiaki Hirosawa, Shiki; Masahiko Fujii, Yokohama, all of Japan

[73] Assignees: New Nippon Electric Co., Ltd., Osaka; Honda Giken Kogyo Kabushiki Kaisha, Tokyo, both of Japan

[21] Appl. No.: 433,912

[22] Filed: Oct. 12, 1982

[30] Foreign Application Priority Data

Oct. 12, 1981 [JP] Japan ..... 56-160913

[51] Int. Cl.[3] ..... F02B 5/00

[52] U.S. Cl. ..... 123/416; 123/414; 123/630; 123/643

[58] Field of Search ..... 123/414, 416, 417, 425, 123/612, 617, 636, 643, 146.5 A, 630

[56] References Cited

U.S. PATENT DOCUMENTS 4,175,507 11/1977 Kawai et al. ..... 123/416
4,378,004 3/1983 Petrie ..... 123/414
4,378,771 4/1983 Sawada et al. ..... 123/425
4,406,272 9/1983 Kiess et al. ..... 123/617

FOREIGN PATENT DOCUMENTS 2422830 12/1974 Fed. Rep. of Germany ..... 123/414
2252026 6/1975 France ..... 123/414
0148963 11/1980 Japan ..... 123/414

*Primary Examiner*—Parshotam S. Lall
*Attorney, Agent, or Firm*—Staas & Halsey

[57] ABSTRACT

An input/output unit modifiable engine ignition control apparatus for controlling ignition timing for engine cylinders at optimum values based on reference position pulses, crank angle pulses generated and a vacuum signal produced by reference position sensors, a crank angle sensor and a vacuum sensor mounted in an engine. The engine ignition control apparatus is divided into an input-output unit and a control unit. The control unit having a control capacity for an engine having a maximum number of the sensors and engine cylinders, so that the control unit can be shared by a variety of engines for their ignition control simply by changing the input-output unit.

8 Claims, 5 Drawing Figures

INPUT/OUTPUT UNIT MODIFIABLE ENGINE IGNITION CONTROL APPARATUS

CROSS REFERENCE TO RELATED APPLICATIONS

This application is related to two applications filed concurrently herewith having U.S. patent application Ser. No. 433,911 and entitled "Control Unit Modifiable Engine Ignition Control Apparatus," and having U.S. patent application Ser. No. 433,913 and entitled "Engine Ignition Interpolation Apparatus" based on Japanese Patent Application No. 160914/81 and No. 160912/81, respectively. This application is also related to U.S. patent application Ser. No. 393,321 entitled "Engine Ignition Control Circuit".

BACKGROUND OF THE INVENTION

The present invention relates to an apparatus for controlling ignition timing for an engine, and more particularly to a unit structure for allowing principal components of such an apparatus to be shared by a variety of engines having different numbers of cylinders and reference position sensors.

Recent rapid developments in electronics technology have resulted in an increased tendency for engine ignition timing to be controlled by a digital system. For example, an electronic engine ignition control circuit for two-wheeled motorcycles is supplied with crank angle pulses generated each time the crank shaft rotates through a unit angle and with reference position pulses indicative of reference positions of the crank shaft. The control circuit counts and processes the crank angle pulses with the reference position pulses being used as references for determining a dwell angle and for controlling ignition timing.

There are many kinds of engines available which have different numbers of cylinders and reference position sensors. It has been customary to provide as many different engine ignition control devices as there are varying kinds of engines. Therefore, fabricating and keeping such engine ignition control apparatus has been quite time-consuming and tedious.

SUMMARY OF THE INVENTION

It is an object of the present invention to provide an engine ignition control apparatus easily adaptable for all types of engines simply by changing a localized block thereof.

It is another object of this invention to isolate a control unit for ignition timing from the high frequency noise caused by ignition coils and spark plugs.

It is a further object of this invention to minimize wiring changes necessary between engines with different numbers of sensors using the same control unit.

According to the present invention, the above objects can be achieved by utilizing an engine ignition control apparatus divided into an input-output unit and a control unit, and constructing the control unit to be shareable by various types of engines, so that all kinds of engines can be controlled for proper ignition timing simply by changing the input-output unit.

These together with other objects and advantages which will be subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
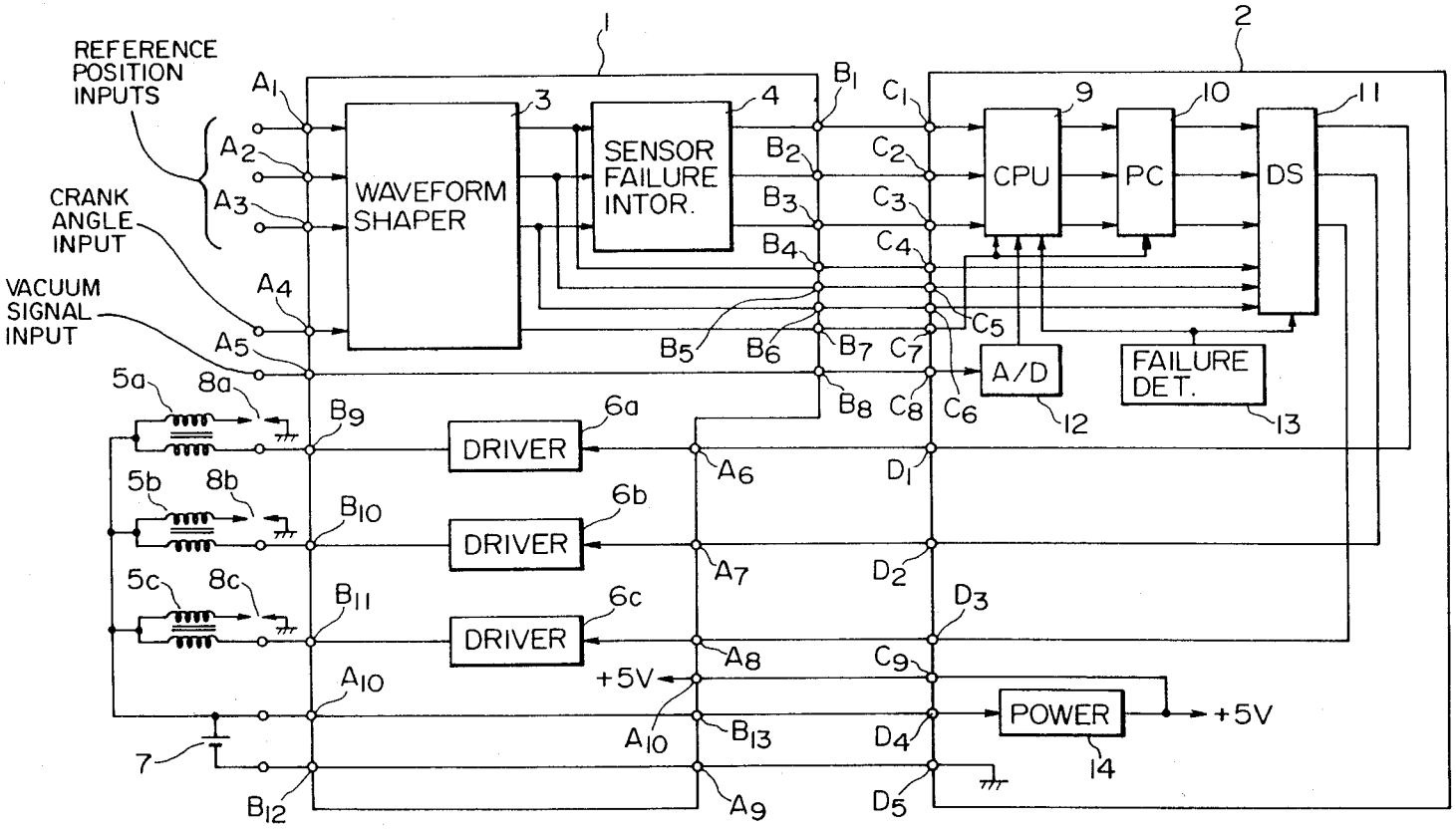
FIG. 1 is a block diagram of an engine ignition control apparatus according to an embodiment of the present invention.

FIG. 1 is a circuit diagram of an engine ignition control apparatus according to an embodiment of the present invention. The engine ignition control apparatus is divided into two units, one being an input-output unit 1 and the other a control unit 2. The input-output unit 1 is constructed for use with, for example, as in-line 6-cylinder engine having the greatest number of reference position sensors. The input-output unit 1 has a group of input ports $A_1$–$A_3$ for receiving three reference position pulses in parallel, an input port $A_4$ for receiving crank angle pulses, and an input port $A_5$ for receiving a vacuum signal. The reference position pulses and crank angle pulses that are supplied to the input ports $A_1$–$A_4$ are shaped into rectangular pulses by a waveform shaper 3. The reference position pulses as shaped by the waveform shaper 3 are delivered through a sensor failure interpolator 4 and output from output ports $B_1$–$B_3$. The shaped reference position pulses and crank angle pulses are also output through output ports $B_4$–$B_7$. The vacuum signal applied to the input port $A_5$ is an analog signal and is output through output port $B_8$ without modification. The input-output unit 1 also includes drivers 6*a*–6*c* energizable by ignition timing signals (described later) supplied to input ports $A_6$–$A_8$ to produce outputs which are supplied via output ports $B_9$–$B_{11}$ to ignition coils 5*a*–5*c*. A battery 6 has a positive terminal connected to the central tap of the ignition coils 5*a*–5*c* and an input port $A_{10}$, and a negative terminal coupled to an output port $B_{12}$. The input and output ports $A_{10}$ and $B_{12}$ are connected directly to input and output ports $B_{13}$ and $A_9$, respectively. Ignition plugs 8*a*–8*c* are connected respectively to the ignition coils 5*a*–5*c*. Although a single ignition plug is shown as being connected to each ignition coil, two parallel ignition plugs mounted on engine cylinders operable in opposite strokes are connected to each ignition coil for the 6-cylinder engine.

The control unit 2 has a central processing unit 9 (hereinafter referred to as a "CPU") supplied with the reference position pulses through input ports $C_1$–$C_3$ to produce outputs that are fed through a programmable counter 10 to a data selector 11. The reference position pulses as supplied through the output ports $B_4$–$B_6$ and corresponding input ports $C_4$–$C_6$ are delivered to the data selector 11. The crank angle pulses as supplied from the output port $B_7$ and an input port $C_7$ are fed to the CPU 9 and the programmable counter 10. An analog-to-digital converter 12 serves to convert the vacuum signal supplied through the output port $B_8$ and input ports $C_8$ into a digital signal, which is then supplied to the CPU 9. A failure detector 13 de-energizes the CPU 9 and controls the data selector 11 in response to the detection of any malfunction. Ignition signals selected by the data selector 11 are supplied through output ports $D_1$–$D_3$ to the input ports $A_6$–$A_8$, respectively. A power supply circuit 14 is supplied with an output from the battery 7 through the output port $B_{13}$ and an input port $D_4$ and converts the supplied voltage into a voltage of +5 V for driving semiconductor devices, which is also fed to the circuits in the input-output unit 1 via an output port $C_9$ and an input port $A_{10}$. A grounded output port $D_5$ is connected to the input port $A_9$ of the input-output unit 1.

The interpolator 4 includes the necessary counters and logic circuits required to replace any reference position pulse that is absent. An interpolation circuit that is adaptable to the present invention is disclosed in the above-mentioned related U.S. Application entitled "Engine Ignition Interpolation Apparatus" incorporated by reference herein.

The data selector 11 includes the necessary logic circuits required to select which ignition signals should be output to drivers 6a–6c. A data selector circuit that is adaptable to the present invention is disclosed in the above-mentioned related U.S. application Ser. No. 393,321 incorporated by reference herein.

The failure detector 13 includes the necessary counters and logic circuits to determine if the CPU 9 or interpolator 4 are properly operating and to generate a malfunction or failure signal controlling the data selector 11. A failure detector 13 adaptable to the present invention is disclosed in the above-mentioned related U.S. application Ser. No. 393,321 incorporated by reference herein.

Drivers 6a–6c are also illustrated in the above-mentioned related U.S. Application entitled "Control Unit Modifiable Engine Ignition Control Apparatus" incorporated by reference herein.

The engine ignition control apparatus thus constructed will operate as follows. Reference position pulses as supplied to the input ports $A_1$–$A_3$ of the input-output unit 1 are shaped by the waveform shaper 3, and then passed to the CPU 9 through the sensor failure interpolator 4 which serves to prevent the engine from stopping because of sensor wire breakage. Crank angle pulses as fed to the input port $A_4$ of the input-output unit 1 are shaped by the waveform shaper 3, and thereafter supplied to the CPU 9 and the programmable counter 10. The CPU 9 and programmable counter 10 count the crank angle pulses with the reference position pulses being used as a reference, and calculate a dwell angle and ignition timing in relation to the vacuum signal supplied from the analog-to-digital converter 12. Based on the result of the arithmetic operation, the CPU 9 and counter 10 produce parallel primary ignition timing signals corresponding to the reference position pulses, respectively, and supply such ignition timing signals to the data selector 11. The data selector 11 successively selects and delivers the primary ignition timing signals or the reference position pulses as fed directly from the waveform shaper 3.

The drivers 6a–6c of the input-output unit 1 drive the respective ignition coils 5a–5c each time they are supplied with the ignition timing signals thereby enabling the ignition coils to produce high-voltage outputs, which are fed to the ignition plugs 8a–8c for ignition.

Engines for use on two-wheeled motorcycles are classified by the number of reference position sensors and the number of required output drivers as shown in the following Table 1:

TABLE 1

| | Reference Position Sensors | Output Drivers |
|---|---|---|
| I In-line 2 cylinders (360° crank) In-line 2 cylinders (180° crank) | 1 | 1 |
| II In-line four cylinders V-2 cylinders | 2 | 2 |
| III In-line 6 cylinders | 3 | 3 |

By constructing the control unit 2 such that it operates for the maximum number of reference position sensors and drivers, the engine ignition control apparatus of the present invention can control ignition timing for all types of engines. The control unit 2 cannot be modified to reduce the number of its parts or simplify the circuit arrangement for a different number of sensors or drivers. However, the input-output unit 1 is affected by a change in the number of sensors or drivers, in that the number of its insertable components is reduced and the circuit configuration is simplified. Therefore, the control unit 2 is constructed to have a maximum capability such that it can be shared by all kinds of engines, while various input-output units 1 may be prepared for use with a variety of engine types to allow a selected input-output unit for a particular engine to be combined with the control unit 2. Since the control unit 2 is composed of expensive components such as the CPU 9, the sharing of the control unit 2 is highly advantageous from the standpoint of cost, assembly and storage. With the input-output unit 1 and the control unit 2 separated from each other, the control unit 2 is prevented from malfunctioning due to high-voltage pulse noise generated by the ignition system. Different cable lengths between the control unit and varying kinds of engines can be overcome simply changing the input-output unit.

Figure 2A:
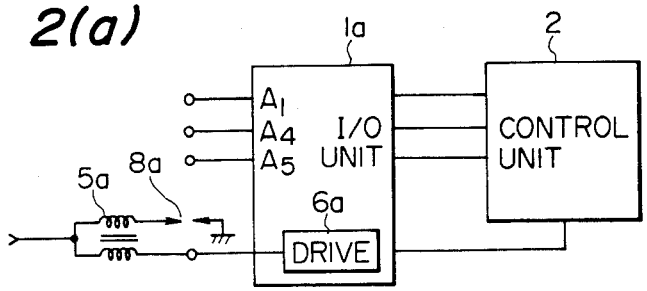
FIGS. 2(*a*)–2(*c*) are block diagrams of engine ignition control arrangements adapted for a variety of engine ignition control arrangements adapted for a variety of engines.
Figure 2B:
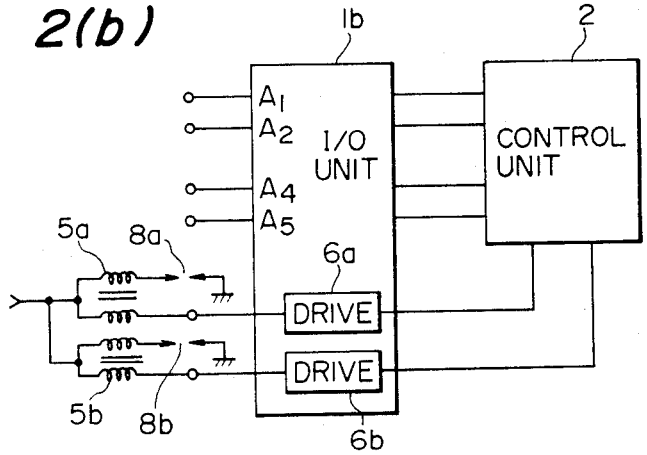
Figure 2C:
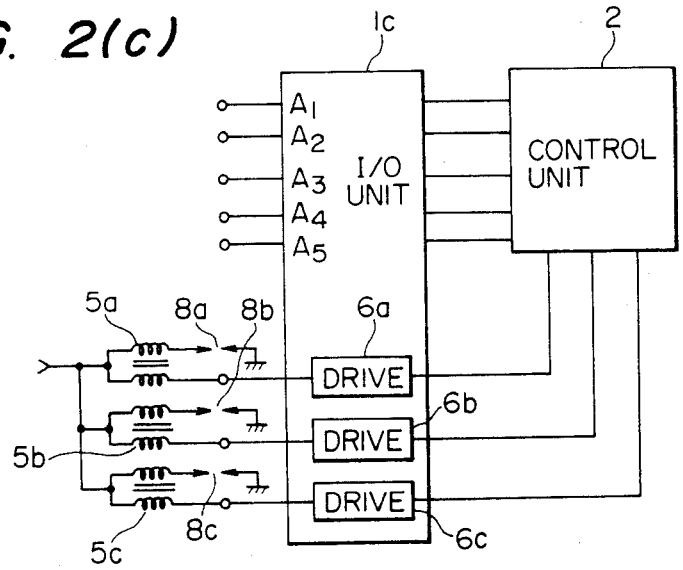

FIGS. 2(*a*)–2(*c*) illustrate different arrangements respectively for the engine types I through III shown in the Table 1. Where only a single reference position sensor and a single ignition coil are employed as with the type I engine, an input-output unit 1*a* having a single driver 6*a* is combined with a control unit 2 as illustrated in FIG. 2(*a*). For the type II engine, an input-output unit 1*b* having drivers 6*a* and 6*b* is combined with a control unit 2 as shown in FIG. 2(*b*). For the type III engine, having an input-output unit 1*c* with drivers 6*a–6c* is associated with a control unit 2 as shown in FIG. 2(*c*) or 1. Thus, the control unit 2 can always be shared by various types of input-output units.

Figure 3:
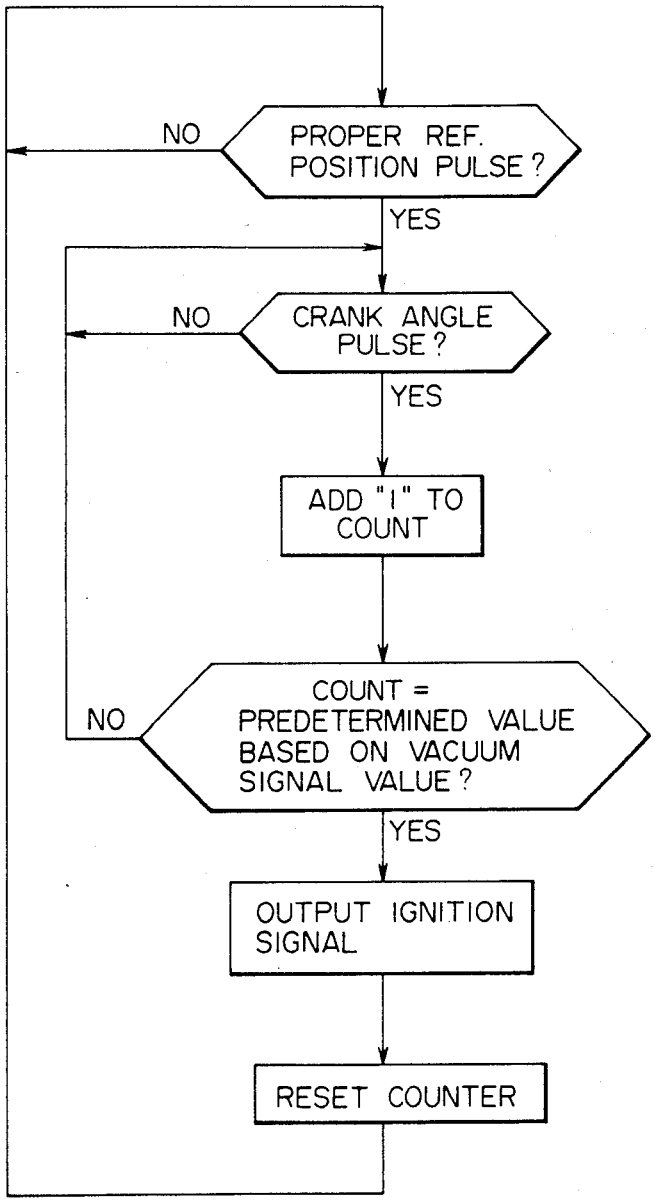
FIG. 3 is a flow chart for a control program for CPU 9 of FIG. 1.

The CPU 9 can be a microprocessor 8048 manufactured by NEC or Intel. A flow chart for a control program capable of controlling the CPU 9 is illustrated in FIG. 3. The flow chart illustrates the necessary steps by the CPU 9 required to generate the signals applied to the programmable counter 10.

As described above, the ignition timing control apparatus of the present invention has been divided into two units, that is, an input-output unit and a control unit, and the control unit has a maximum control capability. Thus, the control unit can be used with various types of engines simply by changing the input-output unit. The control unit which constitutes a major portion of the ignition control apparatus and which is expensive and complicated can be shared by different input-output units. Since the control unit is separated from the input-output unit, the control unit is free from malfunctions which would otherwise be caused by electromagnetic noise produced by the ignition system. A change in the length of the wire cable between the engine and the ignition control apparatus can be accomplished simply by changing the input-output unit.

The many features and advantages of the invention are apparent from the detailed specification and thus it is intended by the appended claims to cover all such features and advantages of the apparatus which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An engine ignition control apparatus operatively connectable to receive reference position signals, a crank angle signal, a vacuum signal and to ignition coils, comprising:

input-output means, operatively connectable to the ignition coils and to receive the reference position signals, the crank angle signal and the vacuum signal, for shaping the reference position signal and the crank angle signal, for interpolating absent reference position signals and for outputting ignition coil signals, said input-output means comprising:

N drivers, operatively connected between the ignition coils and said control means, for driving the ignition coils in dependence upon the ignition signals, where N is an integer equal to the number of engine cylinders divided by 2 and rounded upward;

a waveform shape circuit, operatively connectable to receive the reference position signals and the crank angle signal, for shaping the reference position signals and the crank angle signals; and a sensor failure interpolator, operatively connected to said waveform shape circuit, for generating replacement reference position signals when one or more of the reference position signals are absent; and control means, operatively connected to said input-output means, for generating an ignition signal in dependence upon the reference position signals, the crank angle signal and the vacuum signal, said control means being capable of generating ignition signals for an engine having 1 to 6 cylinders, said input-output means generating the ignition coil signals in dependence upon the ignition signals.

2. An engine ignition control apparatus as recited in claim 1, wherein said control means comprises:

a processing unit, operatively connected to said sensor failure interpolator, said waveform shape circuit and to receive the vacuum signal, for generating ignition control signals in dependence upon the reference position signals, the crank angle signal and the vacuum signal;

a programmable counter, operatively connected to said processing unit and to receive the crank angle signal, for generating primary ignition signals in dependence upon the ignition control signals and the crank angle signals;

a failure detector, operatively connected to said processing unit, for detecting malfunctions and generating a malfunction signal; and a data selector, operatively connected to said programmable counter, said failure detector, said waveform shape circuit and said N drivers, for outputting the primary ignition signals or the shaped reference position signals in dependence upon the malfunction signal.

3. An engine ignition control apparatus as recited in claim 1, wherein said input-output means comprises a case having sufficient input and output terminals to operate with a 6 cylinder engine.

4. An engine ignition control apparatus as recited in claim 1, wherein said waveform shape circuit has the capacity to shape the reference position signals and the crank angle signal for a 6 cylinder engine.

5. An engine ignition control apparatus as recited in claim 1, wherein said sensor failure interpolator has the capacity to generate replacement reference position signals for a 6 cylinder engine.

6. An engine ignition control apparatus as recited in claim 1, wherein said drivers are insertable in said input-output means.

7. An engine ignition control apparatus as recited in claim 1, wherein said control means is capable of generating the ignition signals for engines with from 1 to 6 cylinders without requiring that said control means be modified.

8. An engine ignition control apparatus as recited in claim 1, wherein said input-output means is separate from said control means.

* * * * *